US006434867B1

(12) United States Patent
Ristau

(10) Patent No.: US 6,434,867 B1
(45) Date of Patent: Aug. 20, 2002

(54) MAILABLE ASSEMBLAGE WITH FLEXIBLE APPENDAGES AND METHOD OF FABRICATION

(75) Inventor: Melvin H. Ristau, Dallas, TX (US)

(73) Assignee: MediaGarden, Inc., Ft. Worth, TX (US)

( * ) Notice: Subject to any disclaimer, the term of this patent is extended or adjusted under 35 U.S.C. 154(b) by 0 days.

(21) Appl. No.: 09/476,985

(22) Filed: Dec. 31, 1999

(51) Int. Cl.[7] ..... G09F 1/00; B65D 27/04; B65D 15/00

(52) U.S. Cl. ..... 40/124.06; 40/538; 229/71; 229/92.8

(58) Field of Search ..... 40/124.01, 124.06, 40/124.191, 360, 675, 538; 229/71, 92.8, 921; 283/117

(56) References Cited

U.S. PATENT DOCUMENTS

| | | | | |
|---|---|---|---|---|
| 1,473,800 A | | 11/1923 | Webb | |
| D82,863 S | | 4/1930 | Warren | |
| 1,866,493 A | | 7/1932 | Staats | |
| 3,440,747 A | | 4/1969 | Oliver | |
| 3,977,521 A | * | 8/1976 | Murphy | 40/312 X |
| D252,155 S | | 6/1979 | Okimoto | |
| 4,201,331 A | | 5/1980 | Austin | |
| D272,806 S | | 2/1984 | Handy et al. | |
| 4,448,834 A | * | 5/1984 | Pohl | 428/122 |
| 4,640,030 A | | 2/1987 | Wood et al. | |
| D297,413 S | | 8/1988 | Cantrell | |
| 4,981,211 A | | 1/1991 | Janek | |
| D317,721 S | | 6/1991 | Fiorillo et al. | |
| 5,054,611 A | | 10/1991 | Russomanno et al. | |
| 5,096,229 A | * | 3/1992 | Carlson | 283/75 |
| D329,016 S | | 9/1992 | Scarpa et al. | |
| 5,377,821 A | | 1/1995 | Fierek | |
| 5,613,312 A | | 3/1997 | Crowell | |
| D379,198 S | | 5/1997 | Dowda | |
| 5,626,232 A | | 5/1997 | Volkert et al. | |
| D399,252 S | | 10/1998 | Bashama | |

OTHER PUBLICATIONS http://www.pegweb.com/artsncrafts/card.html; Jun. 1, 1999.
http://www.pegweb.com/artsncrafts/letter.html; Jun. 1, 1999.
http:www.pegweb.com/artsncrafts/letter1.jpg, Jun. 1, 1999.

* cited by examiner

*Primary Examiner*—Brian K. Green
(74) *Attorney, Agent, or Firm*—Locke Liddell & Sapp LLP

(57) ABSTRACT

A method and apparatus designed to facilitate sending items via the mail or other package delivery system in a uniquely designed container. The invention consists of three subassembly layers that are combined via adhesive to form the mailer. One of the unique aspects of the invention is the center subassembly that is not only sandwiched between but also protrudes from the front and back exterior assemblies. The center subassembly, or graphical composite, may be made from variously shaped and colored materials to produce a recognizable or fanciful sign, symbol or picture. The container subassembly houses the item being transported and may be a postcard, envelope, CD sleeve, book cover, or other type of container or communication device.

4 Claims, 3 Drawing Sheets

MAILABLE ASSEMBLAGE WITH FLEXIBLE APPENDAGES AND METHOD OF FABRICATION

TECHNICAL FIELD

The present invention relates generally to a mailer assembly and method, and more particularly to a unique mailable assembly with informational appendages.

BACKGROUND OF THE INVENTION

Envelopes and other containers for transmitting written messages, documents and various other items are conventionally known. Various modifications of these devices have been developed to make them easier and more convenient to use, such as reply envelopes included with the original package, or to make them aesthetically pleasing. For example, U.S. Pat. No. 4,981,211 discloses a videotape cassette storage container having a photograph mat, comprised of a conventional videotape cassette container with a decorative, larger cover mounted on top, where the cover exceeds the container. The photograph mat is used to display a photograph that is relevant to the stored videotape. U.S. Pat. No. 4,640,030 entitled "Combination Envelope and Display Device" describes an envelope comprised of a removable address panel used to produce a window with a surrounding frame for easily exposing the contents of the envelope. The address panel has adhesive on the back and a protective liner and/or paper, which is peeled off the panel to attach it to the envelope. The recipient can then remove the address label upon receipt of the envelope, thereby exposing the envelope contents for display.

One limitation shared by conventional mailable packages is that the package itself is rarely, if ever, used to communicate or assist in communicating a message to the recipient other than by printing words a design or a picture directly on the mailer.

SUMMARY OF THE INVENTION

Briefly summarized, the present invention is an improved mailer consisting of a graphical sub-assembly having at least two faces, a rear sub-assembly bonded to a first face of the graphical sub-assembly, and a front sub-assembly bonded to a second face of the graphical sub-assembly. In the preferred embodiment, at least a portion of the graphical sub-assembly protrudes from the front or rear sub-assembly. Each of the sub-assemblies may have varied physical and informational content complexity. Sandwiched between two semi-rigid (stabilizer) layers is a flexible sheet material core that protrudes beyond the physical dimensions of the two stabilizing layers in such a way that aspects of all three layers are visible from various vantage points when the object is viewed.

Visually the surface of each layer may function as a carrier of information through various imaging techniques. The bounding shape of each layer may also visually describe or assist in describing a sign, symbol, picture or decorative design. In fact, the whole item may be designed to represent a sign, symbol, picture, or decorative design.

Physically each of the three sub-assemblies may have an independent carrier function. When the invention is fully assembled the three sub-assemblies may also perform an integrated physical carrier function for various analog and/or digital information or media.

The various features and characteristics of the present invention will become more apparent when taken in conjunction with the drawings and the following description wherein like referenced numerals represent like parts.

DETAILED DESCRIPTION

The present invention is a method and apparatus designed for use by companies and individuals to send items via the mail or other package delivery system in a uniquely designed container. More broadly, the invention consists of three subassembly layers that are combined via adhesive to form the product. One of the unique aspects of the invention is the center subassembly that is not only sandwiched between but also protrudes from the front and back exterior assemblies. The center subassembly, or graphical composite, may be made from variously shaped and colored materials to produce a recognizable or fanciful sign, symbol or picture. The container subassembly houses the item being transported and may be a postcard, envelope, CD sleeve, book cover, or other type of container or communication device.

Figure 1:
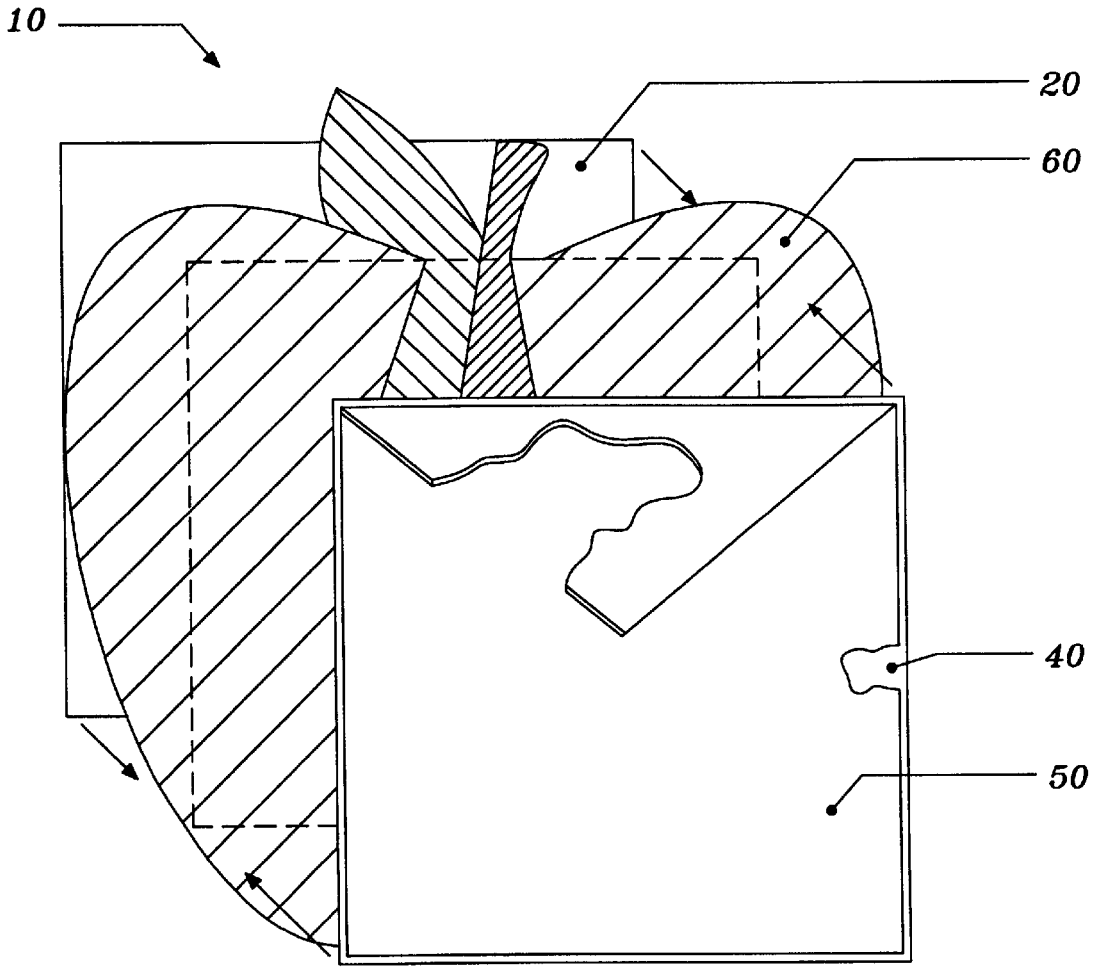
FIG. 1 is an exploded, perspective view of the mailer of the present invention.

Turning now to FIG. 1, one embodiment of the present invention is shown. The mailer 10 is shown in an exploded view. The mailer 10 consists of three sub-assemblies that are secured together: the rear sub-assembly 20, the front sub-assembly 40 including an envelope enclosure 50, and the graphical sub-assembly 60, each of which has various aspects which are visible from various points of view. The rear and front sub-assemblies 20, 40 have several common features and are somewhat interchangeable. Thus, while either the rear or front sub-assembly may be individually discussed at any one time, it is understood that the description presented is equally applicable to the other sub-assembly.

Figure 2A:
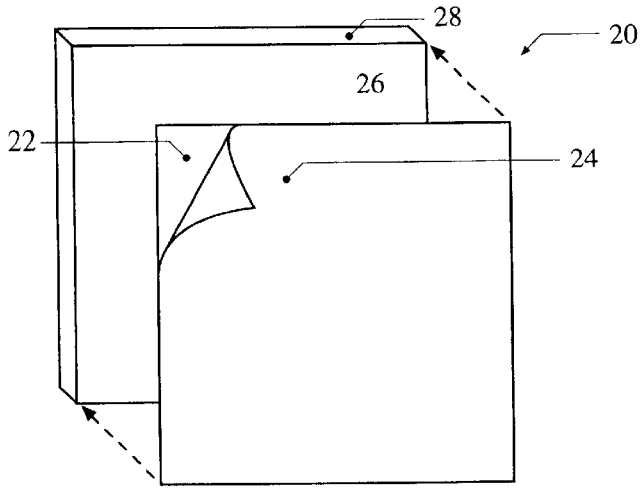
FIG. 2A is an exploded, perspective view of the rear sub-assembly in accordance with the present invention.

As shown in FIG. 2A, in a preferred embodiment, the rear sub-assembly 20 typically comprises a double-sided adhesive 22 with an optional single protective liner 24 applied to the inside face 26 of a formed sheet material 28. The adhesive used may be any of a wide variety known in the art including wet adhesives, pressure-sensitive adhesives and so forth. The sheet material 28 may have a variously shaped outline and may be further imaged, printed or die cut in its interior. This subassembly may vary in thickness and have an internal form distinct from the front sub-assembly 40. The sub-assembly 20 functions as a carrier of analog or digital communication media. The two subassemblies 20,40, once completed, have approximately the same shape, length and width.

The sheet material 28 is typically a semi-rigid material, such as card stock, paperboard, plastic or cardboard, and is used to provide physical stabilization as well as visual communication to the mailer 10. In addition to or in lieu of the sheet material 28, the rear sub-assembly 20 may form a physical carrier and/or information carrier such as that of a card, envelope, pouch, pocket, booklet, sleeve, shallow box, holder, or transformable. Depending, however, on the specific design and purpose of the mailer 10, the sheet material/carrier 28 may in some cases be less rigid than the graphical sub-assembly 60.

Figure 2B:
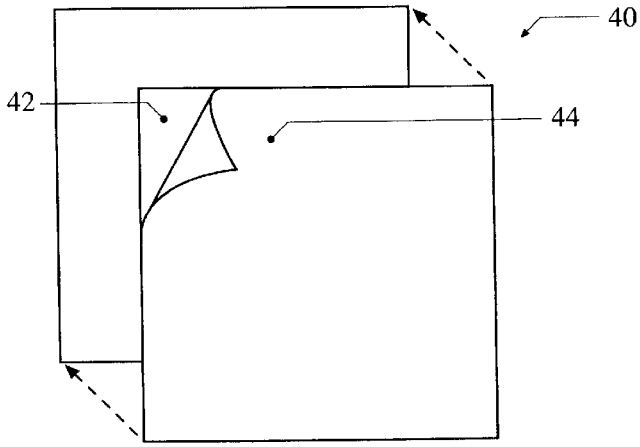
FIG. 2B is an exploded, perspective view of the front sub-assembly in accordance with the present invention.

In FIG. 2B, the front sub-assembly 40 is shown. It is also secured to the graphical sub-assembly 60, such as via double-sided adhesive 42 with an optional single protective liner 44. Besides being variously shaped and graphically decorated, the front sub-assembly 40 may be used to facilitate the mailing process by providing space for postage application and addressing. As stated above, these sub-assemblies 20,40 may have different shape, length, width and thickness. For example, these sub-assemblies 20,40 may consist of simple shaped sheet material such as a rectangle or square; irregularly shaped sheet material with curved edges; sheet material that has been imaged through printing, scoring, or cutting; or folded sheet material that can be formed into a physical carrier such as a card, envelope, pouch, sleeve and so on. Moreover, the front and rear assemblies need not be identically shaped or decorated.

Figure 2C:
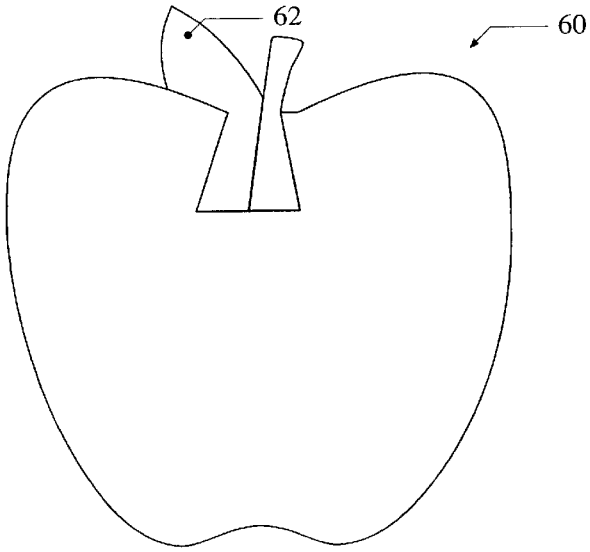
FIG. 2C is an exploded, perspective view of the graphical sub-assembly in accordance with the present invention.
Figure 3A:
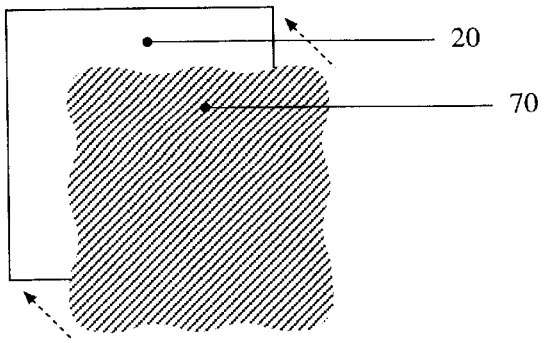
FIG. 3A is an illustration of the initial steps in the formation of the mailer of the present invention.
Figure 3B:
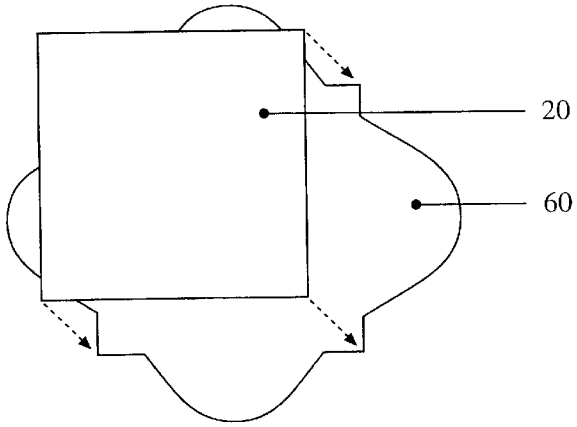
FIG. 3B is an illustration of the steps to adhere the rear sub-assembly to the graphical sub-assembly of the mailer of the present invention.
Figure 3C:
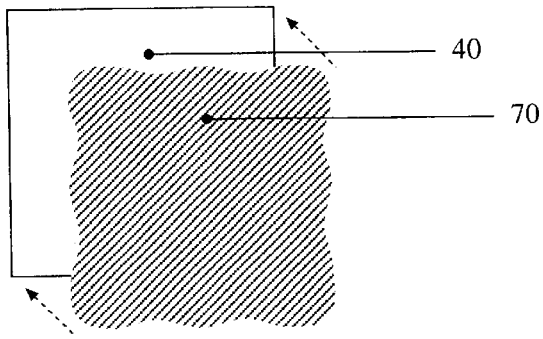
FIG. 3C is an illustration of the steps to apply adhesive to the front sub-assembly of the present invention.
Figure 3D:
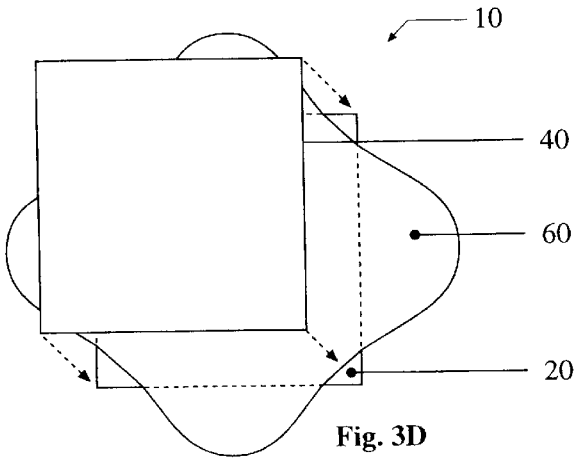
FIG. 3D is an illustration of the steps to adhere the front sub-assembly to the graphical sub-assembly of the mailer of the present invention.

FIG. 2C shows a graphical sub-assembly 60 of the present invention. In the preferred embodiment, the graphical sub-assembly 60 is a flexible sheet material core, part of which protrudes beyond at least one dimension of the front and rear sub-assemblies 20,40. The protrusions are referred to herein as appendages 62. The graphical subassembly 60 may also consist of variously shaped and colored sheet material components arranged in such a way as to render a recognizable sign, symbol or picture, either independently or when combined with the features of the other two subassemblies 20,40. Some dimensions of the graphical sub-assembly 60 exceed the length and/or width of the other subassemblies. The removal of the adhesive protective liners 24,44 of the first two subassemblies 20,40 and the attachment of those subassemblies to the graphical subassembly 60, in accordance with the disclosure provided, form the final assembly of the mailer 10. Besides providing a source of visual communication, the graphical sub-assembly 60 may also serve as a physical carrier in that a void in the sub-assembly 60 may form a compartment when the sub-assembly 60 is combined with the front and rear sub-assemblies 20,40. Various decorative finishing techniques may be utilized with some or all three sub-assemblies 20,40,60.

Turning now to FIGS. 3A through 3D, the method of assembling the mailer 10 is described. As previously mentioned, the graphical sub-assembly 60 is sandwiched between and bonded with the front and rear sub-assemblies 20,40 with its flexible appendages 62 protruding beyond at least one dimension of the front and rear sub-assemblies 20,40. First, adhesive 70 is applied to one face of the rear sub-assembly 20. The adhesive 70 may be applied either wet and remain exposed, or a protective liner may be applied to protect the adhesive until bonding time. The adhesive 70 may be applied either manually or through any of a number of automated processes known in the art. Next, the rear sub-assembly 20 is appropriately positioned and bonded to one face of the graphical sub-assembly 60 in such a way that its visual and integrative functions are accomplished. Then, adhesive 70 is applied to one face of the front sub-assembly 40. Again, the adhesive may be applied with or without a liner. The front sub-assembly 40 is appropriately positioned before and bonded to the side of the graphical sub-assembly 60 opposite the side where the rear sub-assembly 20 was positioned. If a liner was in place over the adhesive 70, it is removed before bonding. The physical complexity and therefore assembly process of these assembly layers is clearly dependent upon the materials used as well as the intended purpose of the formed mailer 10.

One example of the above-described method is as follows. An electromechanical machine is used to apply heated glue to one face of the rear sub-assembly 20. The rear sub-assembly 20 is hand fed into a machine which subsequently feeds it over rollers that apply heated glue. The rear sub-assembly 20 is then removed from the glue applicator machine and immediately positioned and bonded to one face of the graphical sub-assembly 60. The graphical sub-assembly 60 (with the rear sub-assembly 20 bonded to it) is then turned so that the opposing face of the graphical sub-assembly 60 is visible to the assembler. The front sub-assembly 40 is then hand fed into the machine which subsequently feeds it over rollers that apply heated glue in a manner similar to that performed on the rear sub-assembly 20. The front sub-assembly 40 is then removed from the glue applicator machine and immediately positioned and bonded to the visible face of the graphical sub-assembly 60. The assembly process results in the graphical sub-assembly 60 being sandwiched between the rear sub-assembly 20 and the front sub-assembly 40 with the faces opposing the face where the glue was applied of both the rear sub-assembly 20 and the front sub-assembly 40 as well as both faces of the protruding appendages of the graphical sub-assembly 60 being visible from various viewing angles. This process may be adjusted accordingly. For example, if any of the rear, front or graphical sub-assemblies 20,40,60 are composed from multiple pieces of material layered and bonded together, the gluing steps are repeated as necessary to form the mailer. Alternatively, completed sub-assemblies may be stored for later completion of the mailer.

It is intended that the description of the present invention provided above is but one embodiment for implementing the invention. Variations in the description likely to be conceived of by those skilled in the art still fall within the breadth and scope of the disclosure of the present invention. For example, although the front sub-assembly and rear sub-assembly have been described as two independent sub-assemblies, they may be formed from a single, continuous piece of material. Alternatively, they may be individually formed and then joined together in any number of processes known in the art, e.g., gluing, binding, etc. The continuous unit may then be applied to the graphical sub-assembly by wrapping the unit around the graphical sub-assembly and then afixing it to opposing faces of the graphical sub-assembly. While specific alternatives to the method steps of the invention have been described herein, additional alternatives not specifically disclosed but known in the art are intended to fall within the scope of the invention. Thus, it is understood that other applications of the present invention will be apparent to those skilled in the art upon the reading of the described embodiment and a consideration of the appended claims and drawings.

I claim:

1. An envelope comprising:

a front sheet having a perimeter and inner and outer opposed faces;

said outer face of said front sheet including an envelope enclosure, said front sheet being disposed in a first plane;

a back sheet having a perimeter and inner and outer opposed faces, said back sheet being disposed in a second plane, spaced apart from and parallel to said first plane; and a graphic display disposed between said front sheet and said back sheet and adjacent to said inner face of said front sheet and said inner face of said back sheet and disposed in a third plane parallel to said first and second planes, said graphic display including projections extending within said third plane and outside said perimeter of said front sheet and outside said perimeter of said back sheet.

2. The envelope of claim 1 wherein said graphic display includes flexible sheet material.

3. A mailer for transmission from a sender to a recipient, the recipient having an address, the mailer comprising:

a front sheet having a perimeter and inner and outer opposed faces;

said outer face of said front sheet adapted to receive the address of the recipient, said front sheet being disposed in a first plane;

a back sheet having a perimeter and inner and outer opposed faces, said back sheet being disposed in a second plane, space apart from and parallel to said first plane, said back sheet including an envelope enclosure; and a graphic display disposed between said front sheet and said back sheet and adjacent to said inner face of said front sheet and said inner face of said back sheet and disposed in a third plane parallel to said first and second planes, said graphic display including projections extending within said third plane and outside said perimeter of said front sheet and outside said perimeter of said back sheet.

4. The mailer of claim 3 wherein said graphic display includes flexible sheet material.

* * * * *